United States Patent [19]

Biggs

[11] 4,219,036

[45] Aug. 26, 1980

[54] PORTABLE SHELTER

[76] Inventor: Joel T. Biggs, 2 Chomic Pl., Union Beach, N.J. 07735

[21] Appl. No.: 938,699

[22] Filed: Aug. 31, 1978

[51] Int. Cl.[2] ..... A45F 1/16

[52] U.S. Cl. ..... 135/1 R; 135/14 D

[58] Field of Search ..... 135/1 R, 3 R, 4 R, 14 D, 135/14 R, 1 C, 1 D; 52/65, 63

[56] References Cited

U.S. PATENT DOCUMENTS

| | | | |
|---|---|---|---|
| 528,394 | 10/1894 | Rinn | 135/14 D |
| 2,547,770 | 4/1951 | Pelton | 135/4 R |
| 2,964,144 | 12/1960 | Wheeler | 52/65 |
| 3,008,477 | 11/1961 | Bester | 135/4 R |
| 3,054,413 | 9/1962 | Eshelman | 135/4 R |
| 3,169,543 | 2/1965 | McGerty | 135/1 R |
| 4,112,956 | 9/1978 | Small | 135/1 D |

FOREIGN PATENT DOCUMENTS

| | | | |
|---|---|---|---|
| 834228 | 11/1938 | France | 135/3 R |
| 599441 | 11/1959 | Italy | 135/4 R |

*Primary Examiner*—Reinaldo P. Machado
*Attorney, Agent, or Firm*—Roger A. Clapp

[57] ABSTRACT

A six sided shelter unit is disclosed in which a fabric covering is disposed around a support assembly and held in place by a top assembly. The support assembly comprises ribs and support legs which cooperate to shape the fabric into a suitable shelter and the top assembly includes a hinge assembly which allows the shelter to be opened by way of two pivoting gate legs. The two gate legs are constructed to swing back over other support ribs and legs so as to provide an especially wide opening.

10 Claims, 10 Drawing Figures

PORTABLE SHELTER

BACKGROUND OF THE INVENTION

1. Field of the Invention

This invention pertains to large temporary shelters and pertains to those in which a light frame supports a fabric covering.

2. Description of the Prior Art

Fabric covered temporary structures are generally well known such as tents and the like. Heretofore, however, tents big enough to shelter large equipment such as airplanes or motor vehicles have been costly and difficult to erect.

Accordingly, an object of this invention is to achieve a fabric covered shelter which is inexpensive yet easy to erect and operate.

The type of equipment stored often poses difficulty in utilizing existing temporary shelters. Specifically, when a shelter is used to store an especially wide piece of equipment such as an airplane, it is difficult to open wide enough in order to enable easy ingress and egress.

Accordingly, another object of this invention is to achieve an easy to use, inexpensive fabric covered shelter which readily opens wide to accept bulky items for storage.

SUMMARY OF THE INVENTION

In accordance with the preferred embodiment of this invention, tubular legs and ribs cooperate with a unitary top assembly to achieve a temporary shelter which is inexpensive and easy to use.

In accordance with a feature of this invention, the ribs and legs terminate in a top structure which is hinged to cooperate with gate members adapted to swing open over adjacent rib and leg members to provide a wide opening shelter.

A better understanding of the foregoing objects and features of this invention will be facilitated by reference to the following detailed description and drawing.

DETAILED DESCRIPTION OF THE INVENTION

Figure 1:
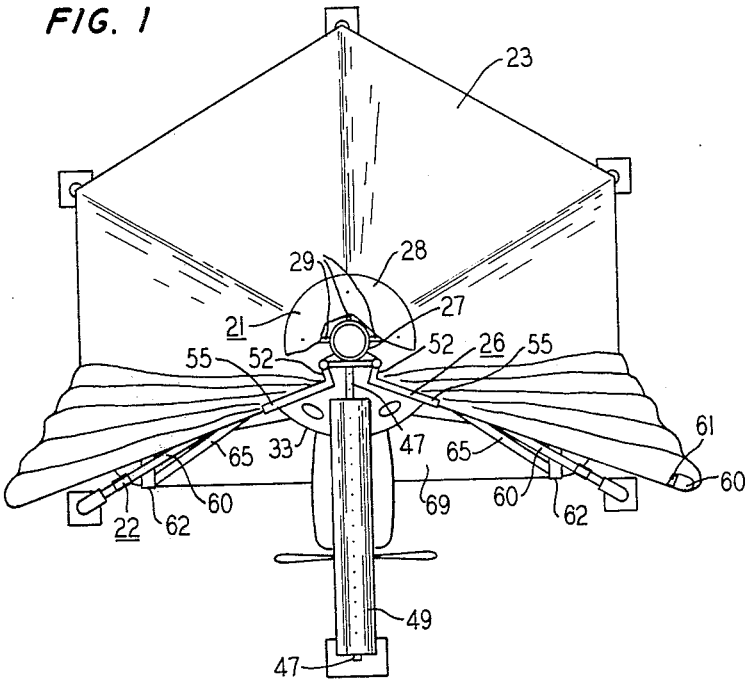
FIG. 1 is a plan view of a shelter unit constructed in accordance with this invention showing the gates in an open position.
Figure 2:
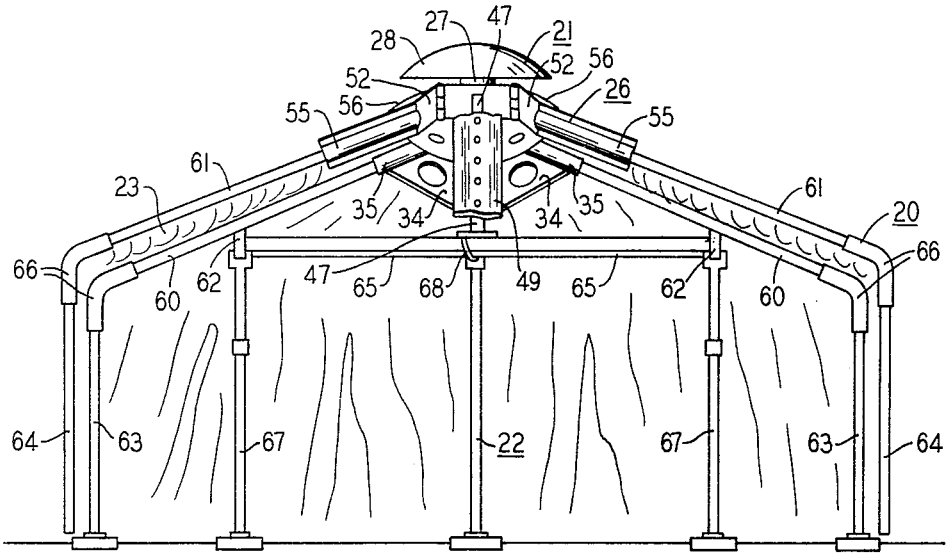
FIG. 2 is an end elevation view of front of the shelter unit depicted in FIG. 1.
Figure 3:
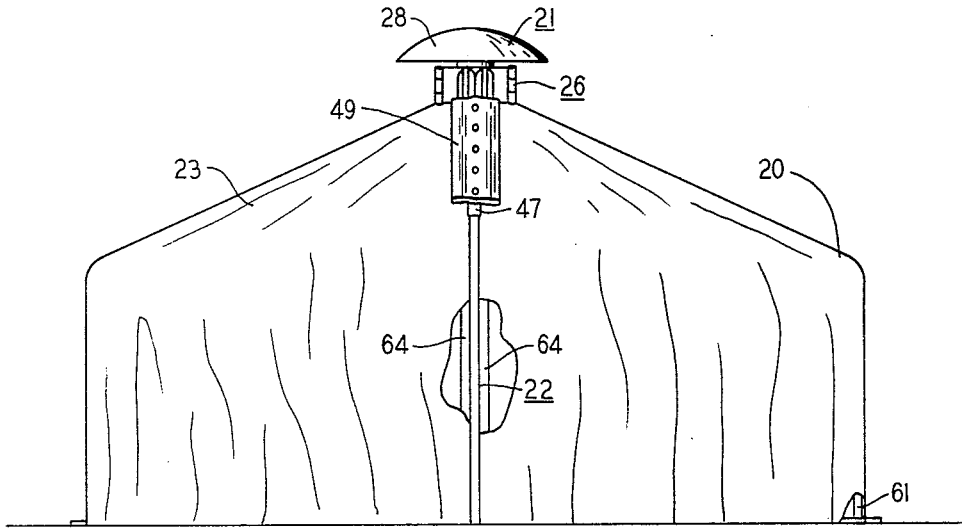
FIG. 3 is an end elevation view of the front of the shelter unit depicted in FIG. 1 and shows the gates closed.

Referring to FIGS. 2 and 3, a shell 20 is disclosed which comprises a top assembly 21, a support assembly 32 and a fabric 23 covering the support assembly 22. The fabric 23 can be any light waterproof material such as canvas. In the embodiment depicted, the shell 20 is approximately 13 feet high and approximately 40 feet across its widest dimension, which, as shown in FIG. 1, is advantageously a hexagon.

Figure 4:
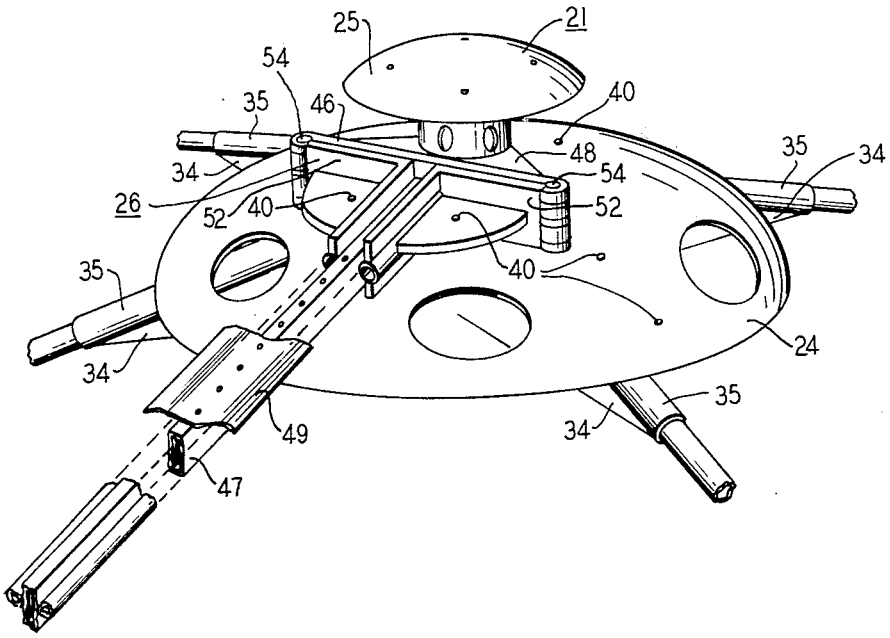
FIG. 4 is a perspective view of a top assembly made in accordance with this invention.
Figure 6:
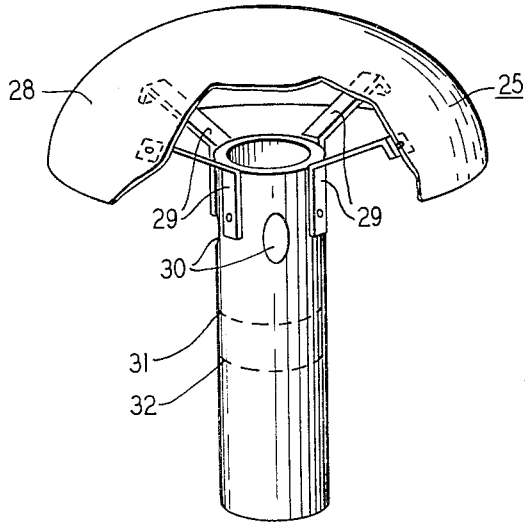
FIG. 6 is a perspective view of a vent unit incorporated in the top assembly depicted in FIG. 4.

The top assembly 21 holds the upper portion of the support assembly 22 together and, as best seen in FIG. 4, comprises a cap unit 24, a vent unit 25 and a hinge assembly 26. The vent unit 25 supports the cap unit 24 and hinge assembly 26 and, as best seen in FIG. 6, comprises a cylinder 27, a cover 28 and fingers 29 which mount the cover 28 on the cylinder 27. The cylinder 27 is made of a strong and rigid material such as steel and is perforated with holes 30 to allow venting from inside the shelter 20. When mounted, the cap unit 24 and hinge assembly 26 are disposed one above the other on the cylinder 27 as at the weld lines 31 and 32.

Figure 5:
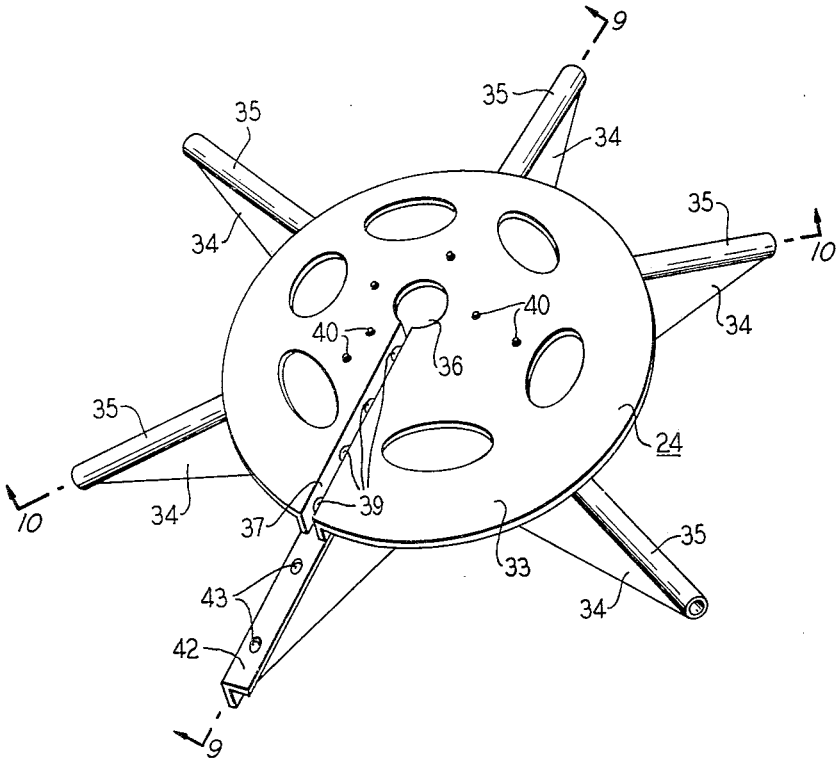
FIG. 5 is a perspective view of a cap unit incorporated in the top assembly illustrated in FIG. 4.
Figure 9:
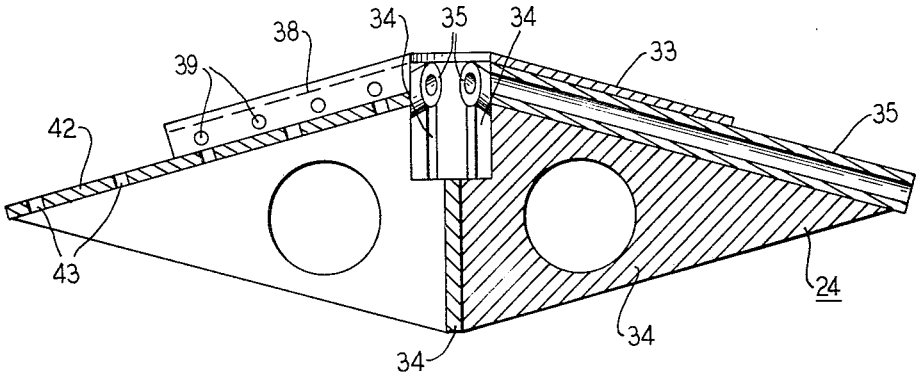
FIG. 9 is an elevation view of the cap unit illustrated in FIG. 5 taken in section along the lines 9—9.
Figure 10:
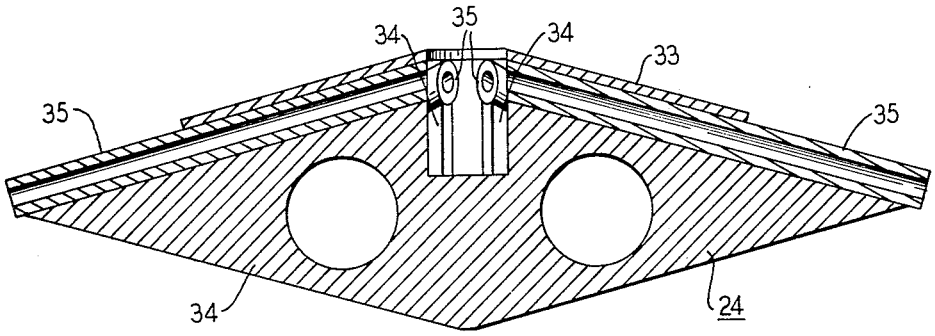
FIG. 10 is an elevation view of the cap assembly illustrated in FIG. 5 taken in section along the lines 10—10.

As best seen in FIG. 5, the cap unit comprises a dish shaped plate 33 which, as shown in FIGS. 9 and 10, cooperates with webs 34 to bracket and hold in place five rib sockets 35. The webs are made of steel and are apertured to reduce weight. Advantageously, the rib sockets 35 are hollow steel cylinders welded to the plate 23 and webs 34 for integral strength. As shown in FIG. 5, the plate 33 has a center hole 36 and a slot 37 communicating between the center hole 36 and the perimeter of the plate 33. As best seen in FIGS. 5 and 9, the slot 37 is defined by the bent-over lips 38. Both lips 38 include mounting holes 39 and the surface of the plate 33 includes fabric snaps 40. A sixth web 41, as shown in FIGS. 5 and 9, having a lip 42 is rigidly mounted beneath the slot 37 as by welding to the other webs 34. As best seen from FIG. 10, all but two of the webs 34 are individual units welded to each other and the aforesaid two to form a unitary structure hollowed at the center to accept the cylinder 27 which is welded in place. As shown in FIGS. 5 and 9, the lips 42 are perforated with mounting holes 43. As shown in FIG. 4, the cap unit 24 is mounted on the vent unit 25 at the weld line 32 where it is welded in place.

Figure 7:
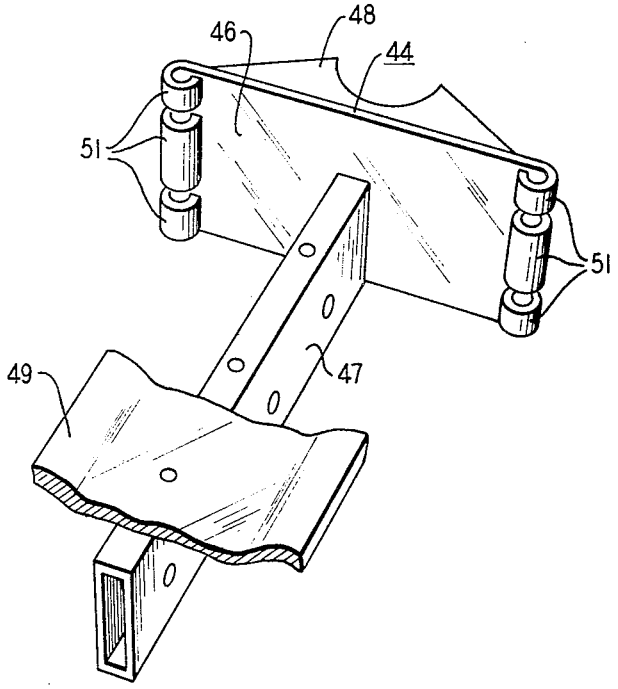
FIG. 7 is a perspective view of a base unit used in a hinge assembly incorporated in the top assembly depicted in FIG. 4.
Figure 8:
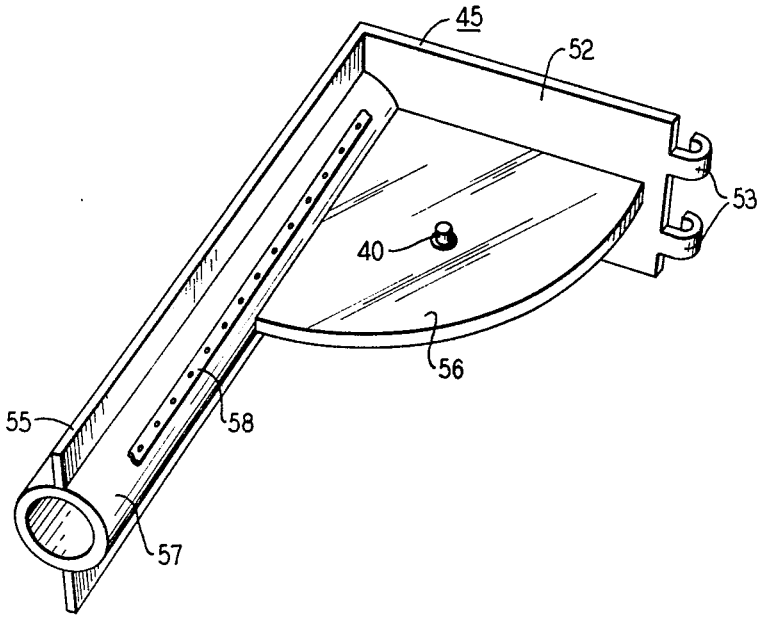
FIG. 8 is a perspective view of a hinge unit used in the hinge assembly referred to in connection with the description of FIG. 7.

The hinge assembly 26, as shown in FIGS. 7 and 8 comprises a base unit 44 and a hinge unit 45. As best seen in FIG. 7, the base unit 44 includes a base plate 46, a channel arm 47, a welding flange 48 and a water diverter 49. The water diverter 49 drains water off the cap unit 24 and is attached to the channel arm 47 as by riveting or the like. The channel arm 47 is mounted as a cantilever with one end attached to the base plate 46 and the other end suspended. Support is supplied by bolts or rivots passing through the channel arm 47 and the lips 38 and 42.

The base plate 46 terminates advantageously in three hinge loops 51 at one end and the welding flange 48 is rigidly attached thereto. The welding flange 48 is arced to fit around the cylinder 27 and is mounted on the cylinder 27 at the weld line 31 where, as can be seen from FIG. 1, it is welded in place.

The hinge unit 45 comprises right and left hand pivot plates 52. Each pivot plate 52 advantageously terminates at one end in two hinge loops 53 adapted to mesh with the three hinge loops 51 on the base plate to form a hinge when joined by hinge pin 54. The other end of each pivot plate 52 terminates in a flange plate 55 mounted at right angles thereto and depending downwardly therefrom at an appropriate angle. The pivot and flange plates are rigidly joined by a web 56 which advantageously includes a fabric snap 40 and is perforated to reduce weight. A gate socket 57 is rigidly attached to each flange plate 55 as by welding and may advantageously include a fabric clip 58. Each gate socket 57 is advantageously a hollow steel cylinder.

As best seen in FIG. 2, the support assembly 22 comprises five support ribs 60, two gate ribs 61, two brace bars 62, five support legs 63, two gate legs 64, two struts 65, seven connectors 66 and four base legs 67. The two gate legs 64 are nominally located at a common point and cooperate with the five support legs to form a hexagon configuration when viewed from the top. The seven connectors 66 join the support legs 63 and the gate legs 64 to the support ribs 60 and gate ribs 61, respectively. The ribs 60 and 61 are held in place by the rib sockets 35 and gate sockets 57, respectively. Finally, the brace bars 62, as best seen in FIG. 1, extend between intermediate portions of two support ribs 60 with one at one side of the shelter 20 and the other on the other side of the shelter 20. The brace bars 62, although not shown, are centrally supported by a center leg and brace arm (not shown) to form a braced T configuration. Finally, the struts 65 extend from the corners of the brace bars 62 to criss-cross under the center of the shelter 20 where they are held in place by a U clamp 68. The shelter 20 is completed by stretching the fabric 23 over the support ribs 60 and gate ribs 61 and snapping it in place with the snaps 40 and under the fabric clips 58.

As shown in FIG. 2, the length of the gate legs 64 is greater than the length of the support legs 63 and the flange plates 55 are disposed so that the gate ribs 61 are higher than the support ribs 60. As a result, the gate legs 61 can alternate between the positions shown in FIGS. 1 and 3. Thus, as the gate legs 61 swing from one position to the other, a wide opening is opened or closed. Consequently, the shelter 20 is particularly adapted to store wide vehicles such as an airplane 69 as shown in FIG. 1.

As shown in FIG. 3, each support leg can be attached to a concrete base or other anchor to keep the shelter 20 in place. It should be noted that the cover 28 extends over all of the hinge assembly and the space left uncovered by the fabric 23. In addition, the water diverter 49 covers the opening between the gate ribs 62 when the shelter 20 is closed. As a result, all exposed parts are covered and the shelter 20 will not leak.

In summary, a fabric covered shelter has been disclosed and described which is simple to use, inexpensive and which readily opens wide to accomodate large equipment such as an airplane or the like. While only one embodiment has been disclosed, it will be understood that it is merely illustrative of the principles in the invention and it is anticipated that many other embodiments will readily occur to those skilled in the art which also will fall within the scope of the invention.

What I claim is:

1. A fabric covered shelter comprising:

a support assembly for accepting and holding said fabric covering in a predetermined shelter shape, said support assembly comprising a plurality of support and gate ribs, support and gate legs and connectors for joining said ribs and legs into pairs, all of said legs being disposed vertically to form a hexagon, said gate legs being longer than said support legs and said gate leg and gate rib pairs engaging ends of said fabric to form opposite sides of an opening in said shelter, and a top unit comprising a vent unit, for venting said shelter a cap unit rigidly holding said support ribs in position, and a hinge unit for rigidly holding and reciprocating said gate ribs between two positions when actuated, said vent unit being disposed vertically with respect to said support assembly, said cap unit being rigidly attached to said vent unit and having a plurality of support rib sockets embracing said support ribs, and said hinge unit being rigidly attached to said vent unit above said cap unit and having a plurality of gate rib sockets for holding said gate ribs at a height above said support ribs whereby said gate ribs will pass over said support ribs when said hinge unit is actuated so as to form a wide opening in said shelter.

2. The combination in accordance with claim 1 wherein said connectors are bolted to said legs and ribs to form fabric supporting knees.

3. The combination in accordance with claim 1 wherein said hinge assembly comprises a base plate having hinges at its opposite ends and each of said hinges supports an inwardly directed hinge plate.

4. The combination in accordance with claim 3 wherein each of said hinge plates supports a gate rib socket extending outwardly at right angles to said base plate and adjacent to the other.

5. The combination in accordance with claim 4 wherein said cap unit includes a convex plate and said gate rib sockets depend downwardly from said hinge plates to lie substantially parallel to and above the surface of said plate.

6. The combination in accordance with claim 5 wherein said gate rib sockets are joined to said hinge plates by webs.

7. The combination in accordance with claim 5 wherein said convex plate is slotted to accept an outwardly directed channel member and is rigidly joined to said vent unit by a plurality of webs.

8. The combination in accordance with claim 7 wherein said channel member supports a water diverter.

9. The combination in accordance with claim 8 wherein said water diverter extends outwardly over said gate rib supports along the length of the entire channel member.

10. The combination in accordance with claim 1 wherein said vent unit includes a cover disposed over the top of said support assembly.

* * * * *